US007579813B2

(12) United States Patent
Fan

(10) Patent No.: US 7,579,813 B2
(45) Date of Patent: Aug. 25, 2009

(54) POWER REGULATOR HAVING A VOLTAGE REGULATOR MODULE AND HAVING A VOLTAGE BUFFER MODULE TO PROVIDE A CONSTANT VOLTAGE OUTPUT

(75) Inventor: Cheng-Shun Fan, Taipei (TW)

(73) Assignee: Inventec Corporation, Taipei (TW)

( * ) Notice: Subject to any disclaimer, the term of this patent is extended or adjusted under 35 U.S.C. 154(b) by 349 days.

(21) Appl. No.: 11/698,888

(22) Filed: Jan. 29, 2007

(65) Prior Publication Data

US 2008/0180082 A1 Jul. 31, 2008

(51) Int. Cl.
*G05F 1/614* (2006.01)

(52) U.S. Cl. ..... 323/231; 323/266

(58) Field of Classification Search ..... 323/231, 323/266

See application file for complete search history.

(56) References Cited

U.S. PATENT DOCUMENTS 3,543,140 A * 11/1970 Krausser ..... 323/231
3,916,508 A * 11/1975 Conzelmann et al. ..... 438/13
4,315,209 A * 2/1982 Schmoock ..... 323/313
4,524,317 A * 6/1985 Millard ..... 323/224
4,562,400 A * 12/1985 Narasimhan ..... 323/281
6,163,141 A * 12/2000 Yoshida et al. ..... 323/266
6,275,013 B1 * 8/2001 Higuchi ..... 323/222
2008/0036433 A1 * 2/2008 Huang et al. ..... 323/266

FOREIGN PATENT DOCUMENTS

TW 200419319 7/2005

* cited by examiner

*Primary Examiner*—Jeffrey L Sterrett
(74) *Attorney, Agent, or Firm*—Rabin & Berdo, P.C.

(57) ABSTRACT

A power regulator with a constant-voltage output is provided, which includes a voltage regulator module and a voltage buffer module, wherein the voltage regulator module is spaced from a load by the voltage buffer module, so that an output voltage of the voltage regulator module is not affected by the current of the load, thereby enhancing the output precision of the power regulator.

5 Claims, 2 Drawing Sheets

POWER REGULATOR HAVING A VOLTAGE REGULATOR MODULE AND HAVING A VOLTAGE BUFFER MODULE TO PROVIDE A CONSTANT VOLTAGE OUTPUT

BACKGROUND OF THE INVENTION

1. Field of Invention

The present invention relates to a power regulator circuit, and more particular to a power regulator with a constant-voltage output.

2. Related Art

As the rapid development of the electronic technology, one electronic system includes various functional circuits with different sizes (e.g., rectifier, filter, transformer, regulator, signal converter, or signal amplifier). In order to enable the electronic system to work normally, power management must be utilized, so as to control and maintain the normal supply of an appropriate current and voltage within the electronic system at any time under different operation states of the electronic system.

The power management circuit is divided into various types, including power regulator, cell charging/measurement, hot plug, and voltage monitor. The power regulator is mainly used for supplying a stable output voltage to the electronic system when the voltage and current of the load of the power supply are changed. However, when being applied in a high precise reference voltage output with a small current, the power regulator is easily affected by a loading effect, so that the output precision is reduced, which has been a problem to be solved as for the high quality design trend.

With reference to Taiwan Patent Publication No. 200419319, a pulse width modulation (PWM) voltage regulator is disclosed, which includes a PWM circuit and a control circuit. The control circuit is operated for reducing the pulse modulation frequency of the PWM circuit, when the current of the load increases, and operated for increasing the pulse modulation frequency of the PWM circuit, when the current of the load decreases.

Although the above patent application can adjust the pulse modulation frequency of the PWM circuit correspondingly according to the change of the current of the load, so as to reduce the power consumption and improve the voltage regulating efficiency, the above control circuit is only applicable for a regulator with a PWM circuit, and thus, it is quite limited in the circuit application scope.

Therefore, when the current of the load changes, the current of the power regulator of the previous stage circuit is affected, so that the problem that the output voltage of the power regulator is affected by the loading effect and thereby being imprecise occurs.

SUMMARY OF THE INVENTION

In view of the above problems, the present invention is directed to a power regulator with a constant-voltage output, wherein a voltage buffer module is connected in series between the voltage regulator module and the load, so that the output voltage of the voltage regulator module is not affected by the loading effect, and thereby enhancing the output precision of the power regulator.

Therefore, the power regulator with a constant-voltage output of the present invention comprises a voltage regulator module and a voltage buffer module.

First of all, when the load changes (e.g., changes from a light load to a heavy load, or changes from a heavy load to a light load), and the current changes accordingly (e.g., changes from a small current to a large current or changes from a large current to a small current), and at this time, the current of the load is provided by the voltage buffer module.

Therefore, the current passing through the voltage regulator module is not affected by the current of the load, and the voltage buffer module generates no loading effect for the voltage regulator module, and thus the output voltage of the voltage regulator module does not change.

Then, through the characteristics of the voltage buffer module, the output voltage of the voltage buffer module equals to that of the voltage regulator module, and the voltage buffer module prevents the current of the load from flowing into the voltage regulator module, thereby improving the output precision of the power regulator.

Through using the power regulator with a constant-voltage output, the voltage regulator module is spaced from the load through the voltage buffer module, so as to prevent the loading effect from affecting the output voltage of the voltage regulator module, and the voltage buffer module further prevents the current of the load from flowing into the voltage regulator module, thereby further improving the output precision of the power regulator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more filly understood from the detailed description given herein below for illustration only, which thus is not limitative of the present invention, and wherein.

DETAILED DESCRIPTION OF THE INVENTION

Figure 1:
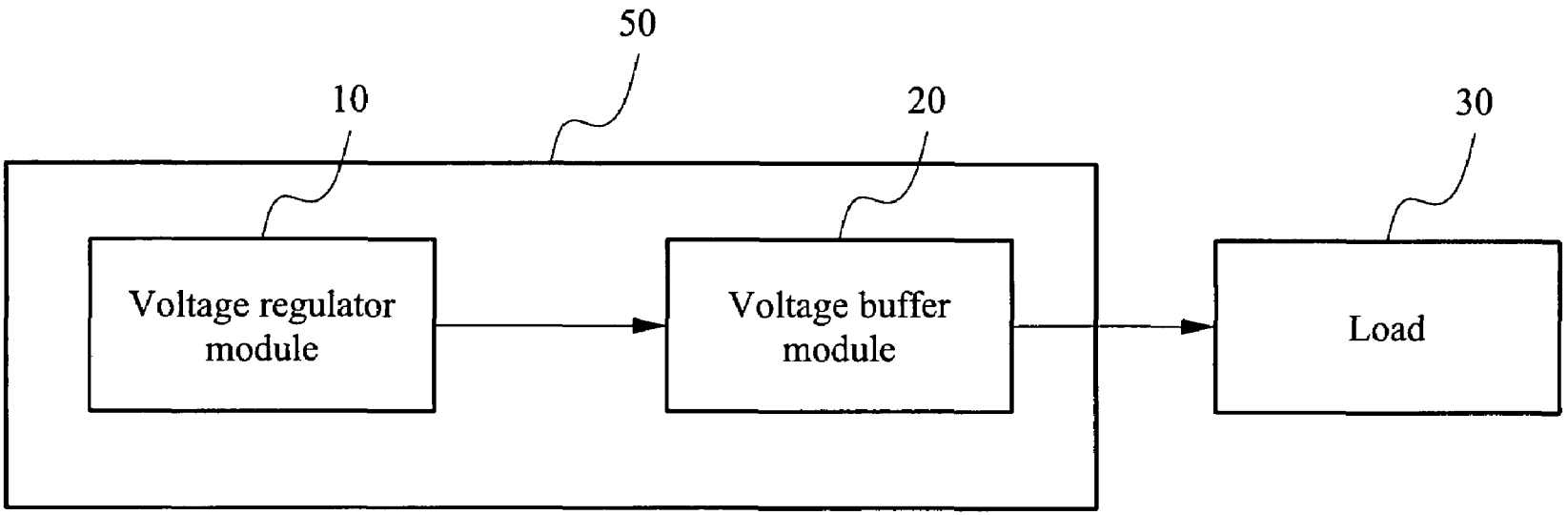
FIG. 1 is a system block diagram of an embodiment of the present invention.

FIG. 1 is a system block diagram of an embodiment of the present invention. As shown in FIG. 1, the power regulator with a constant-voltage output 50 of the present invention includes a voltage regulator module 10 and a voltage buffer module 20, which are individually illustrated below.

The voltage regulator module 10 is used for receiving an input voltage, stabilizing the received input voltage within a predetermined voltage range, and then outputting a stable voltage corresponding to the predetermined voltage range. The voltage regulator module 10 practically adopts the following three types of circuits: a low drop-out linear regulator (LDO), a pulse width modulation (PWM) controller, and a distributed component (e.g., MOSFET), wherein the LDO not only provides a voltage-stabilizing function, but also provides a voltage-reducing function; the PWM controller prolongs a switching period by modulating a cutoff period, thereby greatly reducing the power consumption under a light load and without any load; and the distributed component is used for supplying power for integrated circuits (ICs), which has the main function similar to a switch.

The voltage buffer module 20 is electrically coupled with the voltage regulator module 10 for buffering the stable voltage inputted by the voltage regulator module 10, and thereby spacing the stable voltage spaced from the load 30, so as to avoid the loading effect. Then, the stable voltage is outputted to the load 30 or the next stage circuit, and the voltage buffer module 20 further prevents the current of the load 30 or the current of the next stage circuit from flowing into the voltage regulator module 10. The voltage buffer module 20 practically adopts a super diode circuit, wherein the voltage buffer module 20 is connected in series between the voltage regulator module 10 and the load 30 (the next stage circuit).

Figure 2:
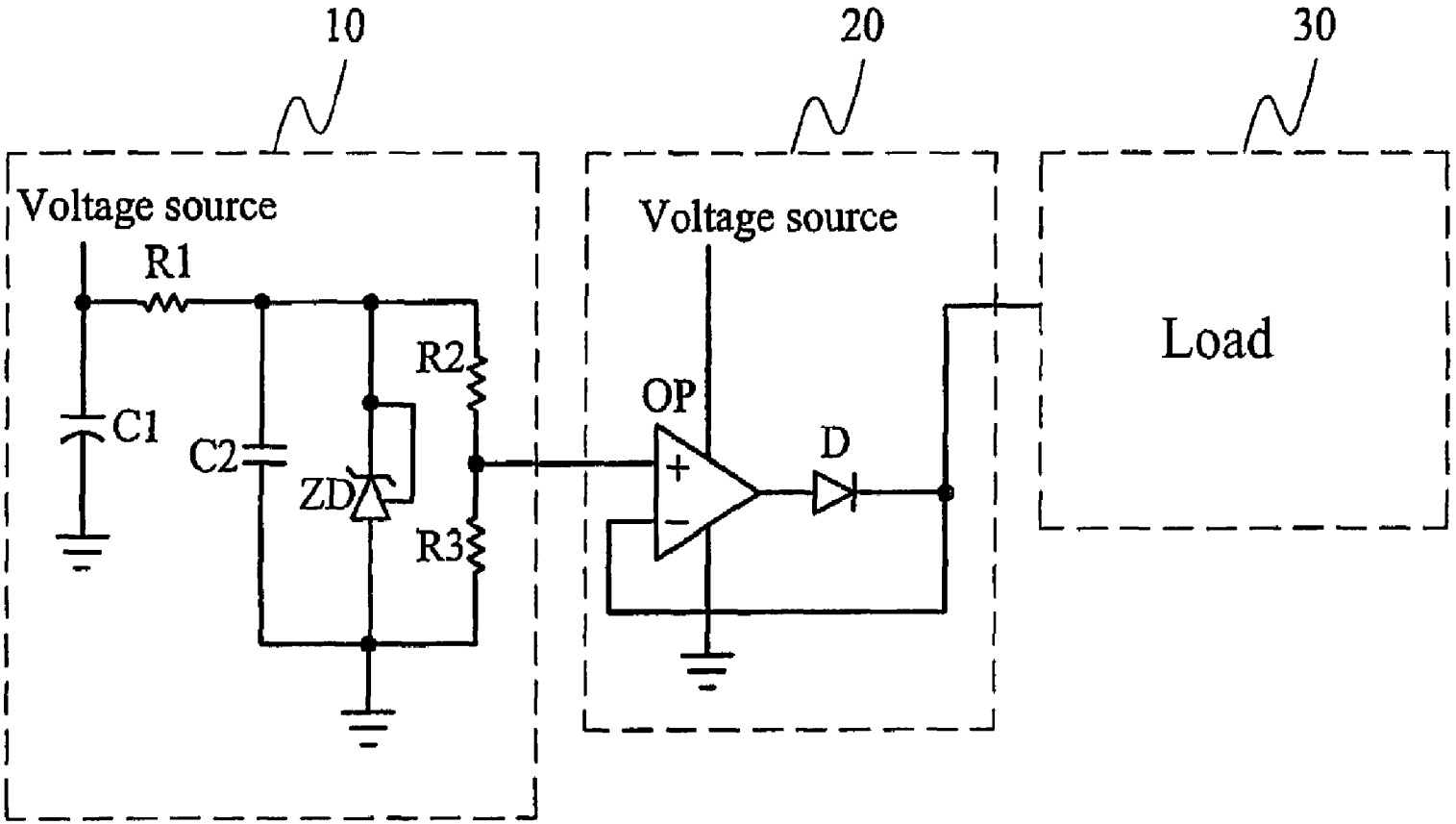
FIG. 2 is a schematic circuit diagram of the embodiment of the present invention.

FIG. 2 is a schematic circuit diagram of the embodiment of the present invention. As shown in FIG. 2, the schematic circuit diagram of a highly precise power regulator of the present invention includes a first capacitor C1, a second capacitor C2, a first resistor R1, a second resistor R2, a third resistor R3, a Zener diode ZD, an operational amplifier OP, and a diode D, and the connection relationship between the circuit components is firstly illustrated below.

First of all, a first terminal (i.e., positive terminal) of the first capacitor C1 is electrically coupled with the input voltage, and a second terminal (i.e., negative terminal) of the first capacitor C1 is electrically coupled with a ground terminal. Then, a first terminal of the first resistor R1 is electrically coupled with the first terminal of the first capacitor C1; a second terminal of the first resistor R1 is electrically coupled with a first terminal of the second capacitor C2, a first terminal (i.e., negative terminal) of the Zener diode ZD, and a first terminal of the second resistor R2; and a second terminal of the Zener diode ZD is electrically coupled with the first terminal (i.e., negative terminal) of the Zener diode ZD.

Then, a first terminal of the third resistor R3 is electrically coupled with a second terminal of the second resistor R2, and a second terminal of the third resistor R3, a third terminal of the Zener diode ZD, and a second terminal of the second capacitor C2 are electrically coupled with the ground terminal, wherein the second capacitor C2 and the Zener diode ZD form a parallel loop, and the second resistor R2, the third resistor R3, and the Zener diode ZD form a parallel loop.

A first input terminal (i.e., positive input terminal) of the operational amplifier OP is electrically coupled with the second terminal of the second resistor R2, an output terminal of the operational amplifier OP is electrically coupled with a first terminal (i.e., positive terminal) of the diode D, a second terminal (i.e., negative terminal) of the diode D is electrically coupled with a second input terminal (i.e., negative input terminal) of the operational amplifier OP and the load 30 (the next stage circuit), wherein the operational amplifier OP and the diode D form a super diode circuit.

Then, the working principle of the circuit is illustrated as follows.

First of all, when the load 30 changes (e.g., changes from a light load to a heavy load, or changes from a heavy load to a light load), and the current changes accordingly (e.g., changes from a small current to a large current, or changes from a large current to a small current), and at this time, the current of the load 30 is provided by the operational amplifier OP. Therefore, the current passing through the Zener diode ZD is not affected by the current of the load 30, and thus the output voltage of the voltage regulator module 10 does not change.

Then, the first input terminal of the operational amplifier OP receives the output voltage of the voltage regulator module 10, and the output terminal of the operational amplifier OP is electrically coupled with the second input terminal of the operational amplifier OP through the diode D, so as to form a voltage follower, and thus, the output voltage of the operational amplifier OP equals to the output voltage of the voltage regulator module 10 received by the first input terminal of the operational amplifier OP. The forward voltage drop of the diode D nearly equals to zero. Therefore, the voltage buffer module 20 generates no loading effect for the voltage regulator module 10, and the diode D further prevents the current of the load 30 from flowing into the voltage regulator module 10.

Through using the power regulator with a constant-voltage output, the voltage regulator module is spaced from the load through the voltage buffer module, so as to prevent the loading effect from affecting the output voltage of the voltage regulator module, and the voltage buffer module further prevents the current of the load from flowing into the voltage regulator module, thereby further improving the output precision of the power regulator.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A power regulator with a constant-voltage output, comprising:

a voltage regulator module, for receiving an input voltage, stabilizing the input voltage in a predetermined voltage range, and outputting a stable voltage corresponding to the predetermined voltage range, wherein the voltage regulator module comprises a first capacitor, a second capacitor, a first resistor, a second resistor, a third resistor, and a Zener diode; and a voltage buffer module, electrically coupled with the voltage regulator module, for buffering the stable voltage, and outputting the stable voltage to a next stage circuit, wherein the voltage buffer module further prevents a current of the next stage circuit from flowing into the voltage regulator module.

2. The power regulator with a constant-voltage output as claimed in claim 1, wherein the voltage buffer module is connected in series between the voltage regulator module and the next stage circuit.

3. The power regulator with a constant-voltage output as claimed in claim 1, wherein a first terminal of the first capacitor is electrically coupled with the input voltage, a second terminal of the first capacitor is electrically coupled with a ground terminal, a first terminal of the first resistor is electrically coupled with the first terminal of the first capacitor, a second terminal of the first resistor is electrically coupled with a first terminal of the second capacitor, a first terminal of the Zener diode, and a first terminal of the second resistor, a second terminal of the Zener diode is electrically coupled with the first terminal of the Zener diode, a first terminal of the third resistor is electrically coupled with a second terminal of the second resistor, and a second terminal of the third resistor, a third terminal of the Zener diode, and a second terminal of the second capacitor are electrically coupled with the ground terminal.

4. The power regulator with a constant-voltage output as claimed in claim 3, wherein the voltage buffer module includes an operational amplifier and a diode.

5. The power regulator with a constant-voltage output as claimed in claim 4, wherein a first input terminal of the operational amplifier is electrically coupled with the second terminal of the second resistor, an output terminal of the operational amplifier is electrically coupled with a first terminal of the diode, and a second terminal of the diode is electrically coupled with a second input terminal of the operational amplifier.

* * * * *